US010221531B2

(12) United States Patent
Plavada

(10) Patent No.: US 10,221,531 B2
(45) Date of Patent: Mar. 5, 2019

(54) AUTOMATIC BOLLARD SECURITY SYSTEM WITH MANUAL OVERRIDE

(71) Applicant: Joy Pappachan Plavada, Bangalore (IN)

(72) Inventor: Joy Pappachan Plavada, Bangalore (IN)

( * ) Notice: Subject to any disclaimer, the term of this patent is extended or adjusted under 35 U.S.C. 154(b) by 0 days.

(21) Appl. No.: 15/525,274

(22) PCT Filed: Oct. 10, 2016

(86) PCT No.: PCT/IB2016/056048
§ 371 (c)(1),
(2) Date: May 8, 2017

(87) PCT Pub. No.: WO2017/060881
PCT Pub. Date: Apr. 13, 2017

(65) Prior Publication Data

US 2018/0209108 A1 Jul. 26, 2018

(30) Foreign Application Priority Data

Oct. 10, 2015 (IN) ..... 5436/CHE/2015

(51) Int. Cl.
*E01F 13/04* (2006.01)
*E01F 13/12* (2006.01)
*G07C 9/00* (2006.01)

(52) U.S. Cl.
CPC ..... *E01F 13/046* (2013.01); *E01F 13/12* (2013.01); *E01F 13/123* (2013.01); *G07C 9/00087* (2013.01); *G07C 2009/00095* (2013.01)

(58) Field of Classification Search
CPC ..... E01F 13/046; E01F 13/123; E01F 13/12; G07C 9/00087; G07C 2009/00095
USPC ..... 404/6, 11; 256/13.1
See application file for complete search history.

(56) References Cited

U.S. PATENT DOCUMENTS

| | | | | |
|---|---|---|---|---|
| 5,476,338 | A | 12/1995 | Alberts | |
| 5,509,753 | A * | 4/1996 | Thompson | E01F 9/529 404/11 |
| 7,118,304 | B2 * | 10/2006 | Turpin | E01F 13/08 404/6 |
| 7,264,417 | B1 * | 9/2007 | Nasatka | E01F 13/08 404/6 |
| 7,439,847 | B2 | 10/2008 | Pederson | |
| 7,983,817 | B2 | 7/2011 | Reed | |
| 8,733,741 | B2 * | 5/2014 | Drax | A01K 3/002 119/528 |
| 8,979,419 | B2 | 3/2015 | Heald | |

(Continued)

FOREIGN PATENT DOCUMENTS

KR 20100124369 11/2010

OTHER PUBLICATIONS

International Search Report for PCT/IB2016/056048. dated Jan. 10, 2017.

*Primary Examiner* — Raymond W Addie
(74) *Attorney, Agent, or Firm* — Stetina Brunda Garred and Brucker; Mark B. Garred

(57) ABSTRACT

A bollard security system for opening and shutting an entrance or exit to a passageway includes a plurality of bollards activated by a drive system including a counterweight. The system includes vehicle and or personnel recognition and authorization system for lowering the bollards. The system can be operated manually when the drive system is non-operational.

16 Claims, 8 Drawing Sheets

Top view

(56) References Cited

U.S. PATENT DOCUMENTS

| | | | | |
|---|---|---|---|---|
| 2005/0031411 | A1* | 2/2005 | Hensley | E01F 13/046 404/11 |
| 2005/0110610 | A1 | 5/2005 | Bazakos et al. | |
| 2005/0238424 | A1 | 10/2005 | Burns et al. | |
| 2008/0159809 | A1* | 7/2008 | Costa | E01F 13/12 404/6 |
| 2008/0226391 | A1* | 9/2008 | Phillips | E01F 13/048 404/6 |
| 2012/0243936 | A1* | 9/2012 | Slagel | E01F 1/005 404/6 |
| 2014/0077927 | A1 | 3/2014 | Mattern | |
| 2015/0139726 | A1 | 5/2015 | Burgin | |

* cited by examiner

AUTOMATIC BOLLARD SECURITY SYSTEM WITH MANUAL OVERRIDE

CROSS-REFERENCE TO RELATED APPLICATIONS

The present application claims priority to International Application No. PCT/IB2016/056048 filed on Oct. 10, 2016 and Indian Patent Application No. 5346/CHE/2015 filed on Oct. 10, 2015, the disclosures of which are incorporated herein by reference.

STATEMENT RE: FEDERALLY SPONSORED RESEARCH/DEVELOPMENT

Not Applicable

BACKGROUND OF THE INVENTION

1. Field of the Invention

The invention relates to a security system for selectively shutting and opening the vehicle entrance or exit or passage ways. It particularly relates to the bollard security system or apparatus for selectively shutting and opening the vehicle entrance or exit or passage ways. It specifically relates to the simple, efficient, automatic and cost effective, bollard security system or apparatus with manual override and method for selectively shutting and opening the vehicle entrance or exit or passage ways.

2. Description of the Related Art

Gate security access control has recently been given increased attention as it provides basic safety protection to the establishments. The security of vehicular movement is the major concern in any of the establishments such as Office, industrial units, housing society etc.

A security barrier or bollard may be used for resisting an unauthorized passage of a vehicle such as a two-wheeler or a car or truck. Such barriers typically comprise housing with a barrier member mounted to it. The housing is typically cast into concrete foundations below ground level. The bather member is arranged to be retractable so that it can be stowed within the housing to allow the vehicle to pass, or deployed to a working position above ground level to prevent or inhibit the vehicle to pass. In the deployed position the barrier member is required to be sufficiently high above ground level to prevent or inhibit the vehicle from passing.

Security barriers are typically provided in two categories. The first category is a high security barrier, or anti-terrorist barrier, that is intended to prevent a vehicle from passing. Such a barrier is robustly constructed and is typically about 915 mm above ground level. A high security barrier might be used at a road entrance to an airport or an official building, such as a Government building, and is typically able to withstand a crash impact from a car or truck. The second category of security barrier might be used at a home or work premises to safeguard a car parking space or driveway from being used by another vehicle. Such barriers are relatively less robustly constructed, and may extend up to one meter above ground level.

There are several types of security barriers reported in the art, the particularly interested one's include U.S. Pat. No. 8,979,419, which discloses a security barrier having a support and a barrier member movable relative to the support between a stowed position and a deployed position, the support having an uppermost part for positioning substantially at ground level, the barrier member being pivotally mounted relative to the support such that a pivot axis of the barrier member is above the uppermost part, wherein the pivot axis is a fixed axis through the entire movement of the barrier member between the stowed position and the deployed position, such that the barrier member only follows the path of a circle between the stowed position and the deployed position.

US20150139726 discloses a barrier system for alternately shutting and opening the vehicle entrance or pedestrian entrance of two lines or transport paths which cross one another and of which one is at least twice as wide as the other. On the four corners of the lines which cross one another, in each case one barrier system with in each case one barrier boom which can be pivoted horizontally out of the vehicle entrance of one line into the vehicle entrance of the other line is installed. Two of the barrier systems which lie diagonally opposite to one another and have in each case one barrier boom which can be folded lengthwise from an elongate position. The two other barrier systems which lie diagonally opposite to one another have in each case one conventional barrier boom which is rigid over its entire length.

U.S. Pat. No. 5,476,338 discloses a bollard type security barrier apparatus for use in controlling ingress and egress to controlled areas. The apparatus is of simple design, easily installed and includes a remotely operated positive drive mechanism for raising and lowering the bollard which is telescopically mounted within a sealed casing adapted to be mounted beneath the ground. The drive mechanism and the bollard are readily removable from the subterranean casing for repair or replacement; and, for certain applications, the upper portion of the bollard can be illuminated.

US20140077927 discloses a method for controlling a gate using an AIE system is disclosed herein. The method can comprise receiving identification data from an identification card using an identification card reader mounted to a first surface of an enclosure and receiving biometric data from a biometric data reader mounted to a first surface of an enclosure. The method can further comprise searching for a profile within a memory that comprises an identification data and biometric data, as well as wirelessly sending an instruction to open a gate, if the profile is authorized.

US20050110610 discloses a system for providing stand-off biometric verification of a driver of a vehicle at a control gate while the vehicle is moving, including a pre-verification system and post-verification systems. The pre-verification system is installed before an entrance of a facility and comprises an RFID vehicle tag reader, an RFID personal tag reader and a facial detection and recognition (verification) system. The RFID vehicle tag reader scans and reads an ID from an RFID vehicle tag of the vehicle that is trying to pass through the gate. The RFID personal tag reader reads an ID from an RFID personal tag carried by personnel who are driving in the vehicle. The facial detection and verification system scans and reads facial images for the driver. The post-verification system is installed on at least one of an entrance and an exit for post-verification to ensure that the vehicle that enters the entrance or leaves from the exit is the one that has been verified/denied at the control gate. In one embodiment, the post-verification system comprises an RFID personal tag reader and an RFID vehicle tag reader. In another embodiment, the post-verification system also comprises a facial detection and recognition system.

None of the prior art references deal with efficient, automatic and cost-effective security systems or equipment for selectively shutting and opening the vehicle entrance or exit or passage ways and there exists drawbacks in the prior art for the security concerns and also the prior art systems are more complex and consume more electrical power which is not eco-friendly. Since the bollard systems discussed above are based on hydraulics, if there is a leak, then the entire area is spilled with oil. In hydraulics, an electric motor is used to rotate the pump and in turn pumps the oil to the cylinders through control valves thus it uses a secondary energy. In electromechanical equipment, a direct motor is used to drive the equipment and balancing technology makes load on drive shaft almost nil, thus we reduce power requirement.

Therefore, the present invention's aim is to overcome the drawbacks of the prior art systems by developing the simple, efficient, automatic and cost-effective security systems or equipment[s] with manual override for selectively shutting and opening the vehicle entrance or exit which consume minimum electricity and are eco-friendly.

SUMMARY OF THE INVENTION

An automatic security system for selectively shutting and opening the vehicle entrance or exit or passage ways is disclosed. The security system comprises a base structure for housing a support structure and a main frame. The main frame comprises a plurality of bollards. The main frame further comprises a drive system for moving the bollard up and down. The main frame further comprises a guide system for guiding movement of the bollard. The main frame further comprises counterweight coupled to the plurality of bollards to balance the bollards when moving up and down. The security system comprises at least one sensor for identification of a vehicle or a person to initiate movement of the bollards in up or down direction.

The number of bollards varies from 1 to 5 or more depending on the size of the passage way or as per the impact load and the height of each bollard vary from 1500 mm to 2700 mm or as per the user requirement. The base structure construction of base is done precisely to enable the other supporting members/components to be accommodated and it is made in such a way that it can be used for any further additional fittings. The support structure is assembled to the base frame with ISMC or an equivalent grade material and other members/components of the frame in such a way that it can take the complete upward and downward movement of the bollard along with complete load of the vehicle passing on it.

The main frame accommodates the drive system for moving the bollard by the precisely made guide and the weight of moving bollard is balanced by counterweight and the complete loads are effectively born by the main frame. The drive system for moving bollard up and down is characterized in that having a gear box with a motor for movement along with a drive shaft and a pulley which upon receiving instruction/information moves the bollards up or down through a top plate. The male part of the guide system is made of tool steel with phosphorous or of any equivalent grade material and female part is made of tool steel with phosphorous bronze or any equivalent grade material fitted to the meshing part to reduce the wear and tear. Security system characterized in that the counterweight bears the nearly equivalent load of the moving bollard and that will minimize the load on the drive motor and will help to do the manual override. Counter weight can also be fitted with specially designed guide. The system to identify and recognize the vehicle or person in the stored information in database can be card reader or biometric system or any type of signal generation mechanism. In case of power failure manual override is provided for operating manually.

A method for automatic security system for selectively shutting and opening the vehicle entrance or exit or passage ways comprising: installing the automatic security system of the invention and recognition of the incoming vehicle(s)/person(s) by the stored information in the database; after identification moving the bollard down for vehicle passage and then after passage of the vehicle through exit sensor, automatically rising of the bollard to normal position for security.

The bollard movement is so quick that the time taken for going down and rising can be within 1 to 3 seconds and if required it can be operated very slow or fast as well.

The primary object of the present invention is the development of security system for selectively shutting and opening the vehicle entrance or exit or passage ways.

The other object of the present invention is for the development of bollard security system or apparatus for selectively shutting and opening the vehicle entrance or exit or passage ways.

Another object of the present invention is for the development of a simple security system or apparatus for selectively shutting and opening the vehicle entrance or exit or passage ways.

Another object of the present invention is for designing and development of the automatic security system or apparatus for selectively shutting and opening the vehicle entrance or exit or passage ways.

Another object of the present invention is to develop the security system or apparatus for selectively shutting and opening the vehicle entrance or exit or passage ways which uses the reduced power consumption and hence it is eco-friendly. Also, the system can be operated manually, In the case of an eventuality, instantly power supply will be sabotaged. In the present invention, this system can be operated UP and DOWN any number of times manually without the requirement of power.

Yet another object of the present invention is to develop cost-effective security system or apparatus for selectively shutting and opening the vehicle entrance or exit or passage ways.

An object of the present invention is to develop hassle free and easy maintainable security system or apparatus for selectively shutting and opening the vehicle entrance or exit or passage ways.

Further object of the present invention is to develop the method of operation of security system or apparatus for selectively shutting and opening the vehicle entrance or exit or passage ways Further object of the invention is to explore the usage of developed security system or apparatus for selectively shutting and opening the vehicle entrance or exit or passage ways.

DETAILED DESCRIPTION OF THE INVENTION

The invention relates to an automatic bollard security system for selectively shutting and opening the vehicle entrance or exit or passage ways. It particularly relates to the bollard security system or apparatus for selectively shutting and opening the vehicle entrance or exit or passage ways. It specifically relates to the simple, efficient, automatic and cost effective, bollard security system or apparatus and method for selectively shutting and opening the vehicle entrance or exit or passage ways with manual override.

Bollards:

The novel developed security system/equipment contains rising bollards made of M S Section fabricated with 150 mm diameter and 12 mm thick (thickness can vary as per the impact load) seamless tube or an equivalent section and top covered with SS Sheathing or without sheathing for the top part and bottom is fabricated with INDIAN STANDARD METRIC CHANNEL (ISMC) 150 mm×75 mm or of an equivalent suitable material. ISMC is a steel channel which is C-shaped, and is considered as a standard in fabrication. The equivalent for ISMC is the metric channel (MC) that is considered as a standard in the United States of America.

Bollards frame is moving on machined and hardened guides attached to a fabricated structure. It can work without guide also. This structure is fully fabricated with ISMC 150 mm×75 mm or equivalent section with necessary stiffeners for withstanding any impact load.

The total enclosure is erected inside the earth (underground) on the road or passage. The top is Stainless Steel Chequered Plate or equivalent material. Card Reader is placed approx. 5 meters before the Bollards and Exit Sensor is placed approx. 4 meters after the Bollards or as per the condition and requirement of the user.

Figure 1A:
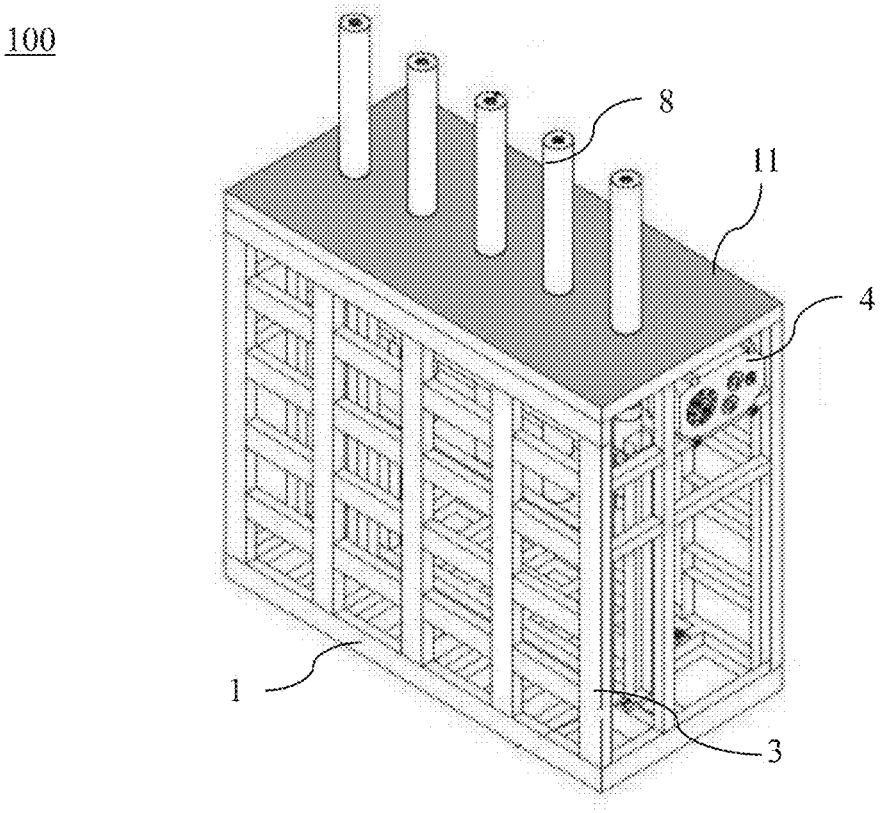
FIG. 1A illustrates a security system comprising bollards.
Figure 1B:
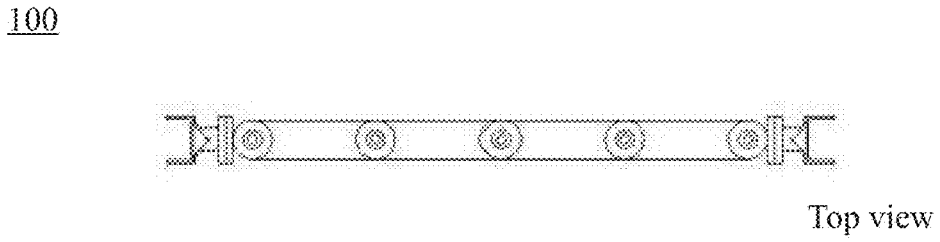
FIG. 1B illustrates a top view of the security system.
Figure 2:
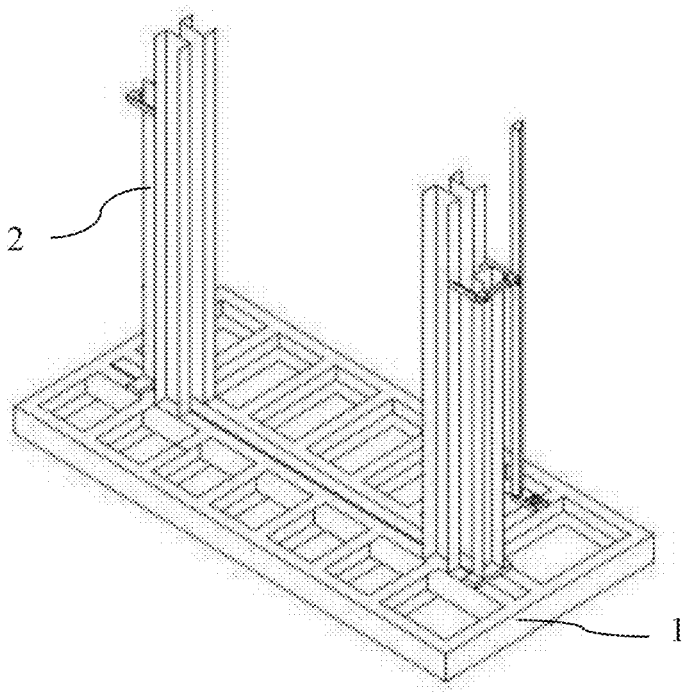
FIG. 2 illustrates the security system comprising base structure and a support structure.

Referring to FIGS. 1A-7B, an automatic security system (100) is described. FIG. 1A illustrates the automatic security system (100) comprising bollards (8). FIG. 1B shows top view of the automatic security system (100). The automatic security system (100) comprises a base structure (1). The automatic security system (100) comprises a support structure (2) provided in perpendicular to the base structure (1), as shown in FIG. 2. The automatic security system (100) further comprises a main frame (3) provided in perpendicular to the base structure (1), as shown in FIG. 1A and FIG. 3. The support structure (2) and the main frame (3) are used to support other components of the automatic bollard system (100).

Figure 4:
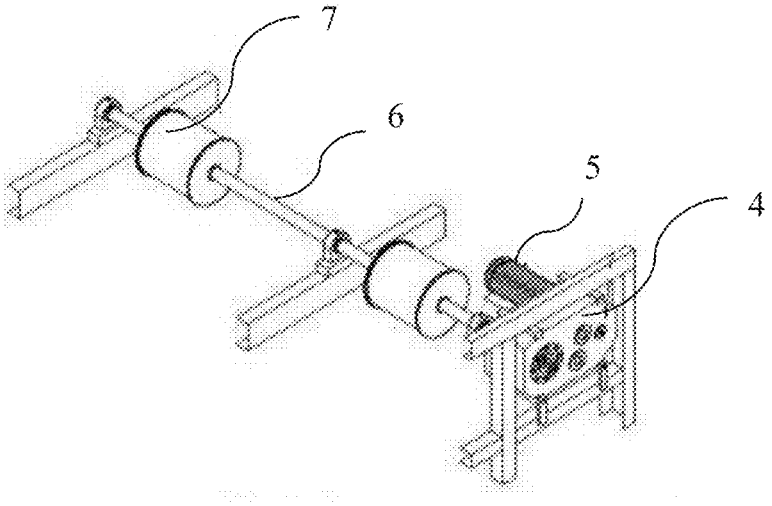
FIG. 4 illustrates the security system comprising a gear box.
Figure 5:
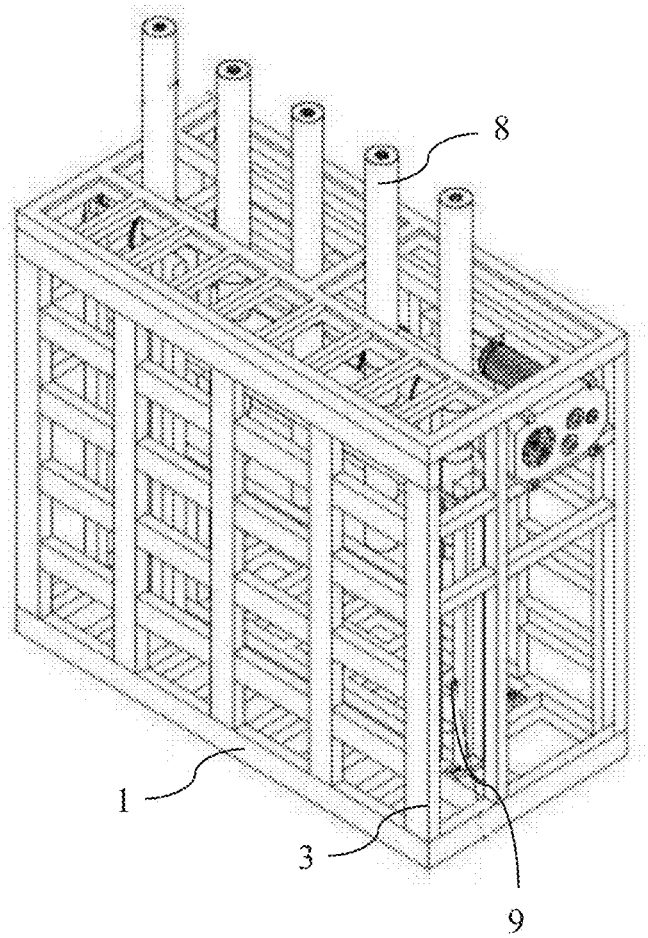
FIG. 5 illustrates the security system comprising a guide system.
Figure 6:
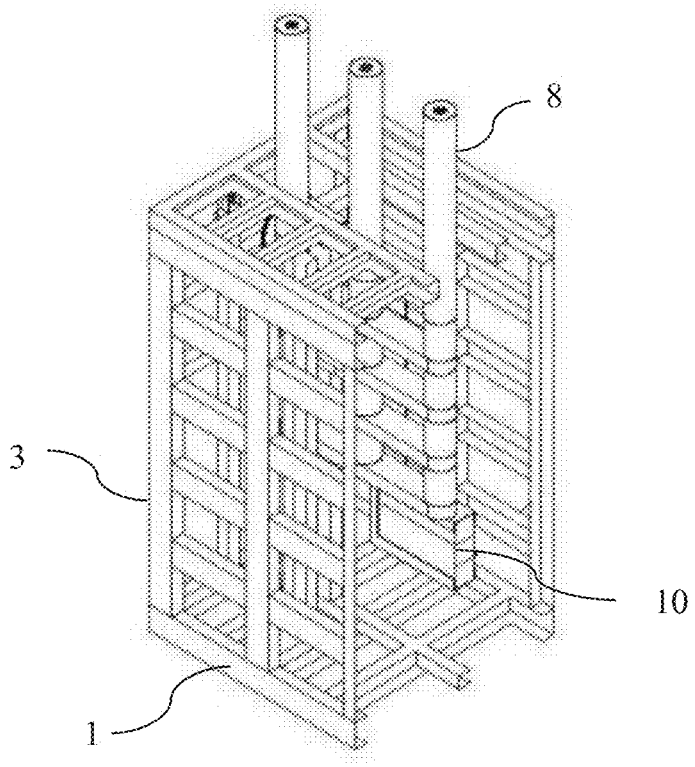
FIG. 6 illustrates a cross-sectional view of the security system comprising a counterweight.
Figure 7A:
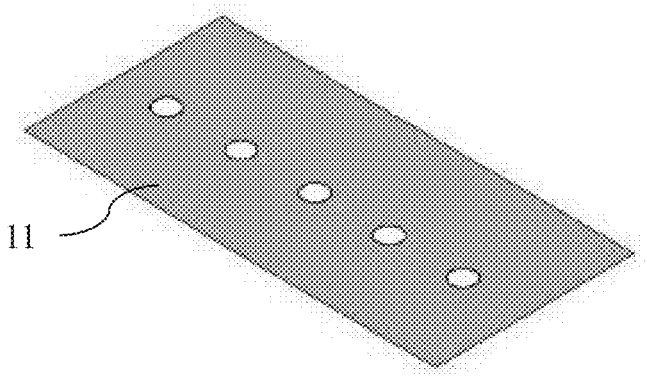
FIGS. 7A and 7B illustrate a perspective view and top view of a top plate.
Figure 7B:
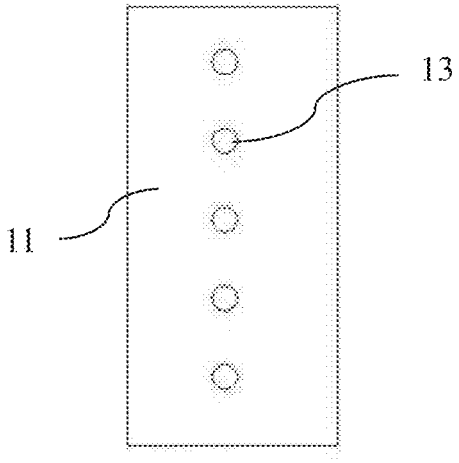

The automatic security system (100) comprises a drive system or a gear box (4), as shown in FIG. 1A. Referring to FIG. 4, the gear box (4) comprising a motor (5) for movement along with a drive shaft (6) and a pulley (7) is shown. Referring to FIG. 5, the automatic security system (100) comprising a guide system (9) is shown. The guide system (9) is provided around each of the bollards (8) such that the bollards (8) move up or down along the inner surface of the guide system (9).

The automatic security system (100) further comprises a counterweight (10) coupled to the bollards (8) and the drive system (4) and the gear box (9). The automatic security system (100) is covered by a top plate (11) as shown in FIG. 1A. The top plate (11) comprises holes (13).

The automatic security system (100) further comprises a control panel (12) provided outside of the components described above. The control panel (12) is used to operate the automatic security system (100) to operate the drive system (4) either manually or automatically.

Construction of each component of Bollard Security System is presented in detail:

Base Structure (1):

The bottom part of the frame made of ISMC (INDIAN STANDARD METRIC CHANNEL) or with equivalent section. It is heavy and strong enough to take the complete load. The construction of base is done precisely to enable the other supporting members/components can be accommodated. The base is with locator for easy erection. It is made to withstand or accommodate for any further additional fittings.

The Support Structure (2):

The main support structure (2) is assembled to the base frame (1) with ISMC and other members/components of the frame, it can take the complete upward and downward movement of the popup bollards and complete load of the vehicle passing on it. The moving parts and other sets of the parts are fitted to this.

Main Frame (3):

The main frame (3) is the total shell of the automatic security system (100). The main frame (3) is made of ISMB and other supporting sections and materials. The main frame (3) accommodates the popup bollards (8), the drive system (4) and the guides (9) with the counterweight (10). The popup bollards (8) are moving on the precisely made guide (9) and weight is balanced by the counterweight (10). These complete loads are effectively born by the main frame (3).

Gear Box or the Drive System (4).

The motor (5) is connected to the gear box (4) for the speed regulation. This is fitted to the drive system. This is made of specially built, hardened gears designed to deliver specific speed at calculated torque.

Motor (5).

Special motor with S4 DUTY winding is used in this equipment, which can operate several times in an hour. It is to be noted that the term DUTY defines the load cycle to which a motor is subjected, including, if applicable, starting, electric braking, no-load etc. The S4 DUTY is defined as a sequence of identical duty cycles of a motor, each cycle including a predefined starting time, a time of operation at constant load and a time de-energized at a rest. Standard or any other types of motors also can be used. The capacity of the motor is as per the requirement of the automatic security system (100).

Drive Shaft (6).

This is of special tool steel or equivalent machined precisely to withstand the load and impact.

Drive Pulley (7).

The shape of the pulley (7) is as per the load of the equipment. This is of special steel roller made to wind and unwind the load bearing rope. The popup bollards and counterweight is fitted to this shaft.

Bollard (8).

Heavy seamless tube or equivalent section is used to make BOLLARD. For two-wheeler bollards, the seamless tube pipe of 150 mm diameter and 13 mm thickness is used as the bollard and ISMC is used for the connecting the tubes together. The assembly is used as the popup bollards. The total height of the popup bollards are 2300 mm and 1150 mm top part is sheathed with 2 mm thick SS 304 grade pipe. The protruding is 915 mm from the road level. Number of bollards will vary as per the requirement, for two wheelers it can be 1 to 2 popup bollards and for four (and more) wheelers it can be from 5 to any numbers of bollards as per the impact load or size of the passage way.

In one of the embodiment the bollard top is of 2700 mm length and 1500 mm width for normal 4-wheeler bollards and for 2-wheeler the length is 1500 mm and width is 1500 mm. The card reader is placed 5 meter before popup bollards and exit sensor is placed 4 meter after the bollards for both sets. The gap between the popup bollards for 4-wheeler is varying from 317 mm to 400 mm depending on the length of the equipment. For 2 wheelers, it is 400 mm approximately. The width remains 1500 mm and the length varies as per the requirement.

Guide System (9).

The male part of the guide is made of tool steel or equivalent grade material machined as per the requirement. The female part is made of tool steel with phosphorous bronze or of any equivalent grade material fitted to the meshing part, to reduce the wear and tear. Both these parts are finished with scrapping. This is fitted in such a way that it will automatically align back in case of an impact.

Counter Weight (10).

The counterweight (10) is an equivalent load of the popup bollards (8). This will minimize the load on the drive motor (6) and will help to do the manual override. This is made of steel square rod of required size machined and fitted with necessary clamps. It is made of steel square rod instead of lead. The lead counterweight (10) is not eco-friendly. It can be of any material, only requirement is it should have equal weight of bollard (8) and its shape may vary. It also should move as per the movement of the bollard (8).

Top Plate (11).

Stainless Steel, 304 grade chequered plate (or equivalent material) is used as the top plate (11). It will allow vehicle to pass with little resistance. The holes (13) are made for popup bollards to come up, with necessary stiffener plates.

Control Panel (12).

The control panel (12) consists of a panel board with all mounted accessories. The main component/part of the control panel is the PLC. The control is through PLC and other accessories like sensors, control switches, limit switches, contactors, proximity switches and indicators etc.

Card Reader/Identification: The card reader or signal supplier (14, explained in subsequent part of the description) can be of any type. It can be of computer command of card reader, biometric, voice command, android signal, or any type of electronic energizing signal or any type of signal can be used. It reads/recognises/identifies the incoming vehicle/person and transmits the signal accordingly as per the stored information in the database. This signal will energise the system which start with this signal and go for its cycle of operations.

Referring to FIGS. 1A-7, the working of the automatic security system (100) is described. The automatic security system (100) may comprise 5 or more bollards (8) as shown. As presented above, the automatic security system (100) comprises the base structure (1), the support structure (2), the main frame (3) which accommodates the drive system (4) for moving the bollards (8) by the precisely made guide (9) and the weight of moving bollard is balanced by the counterweight (10) and the complete loads are effectively born by the main frame (3). The drive system (4) for moving bollard up and down is having the gear box (4) with the motor (5) for movement along with the drive shaft (6) and the pulley (7) which upon receiving instruction/information moves the bollards up or down through the top plate (11). The top plate (11) is having 5 openings or holes (13) which facilitates for the movement of bollards up and down and the distance between bollards vary from 317 mm to 400 mm depending on the length of the equipment and the width of each bollard is 1500 mm. The control panel (12) consists of a panel board with all mounted accessories. The main component/part of the control panel is the PLC. The control is through PLC and other accessories like sensors, control switches, limit switches, contactors, proximity switches and indicators etc.

Figure 8:
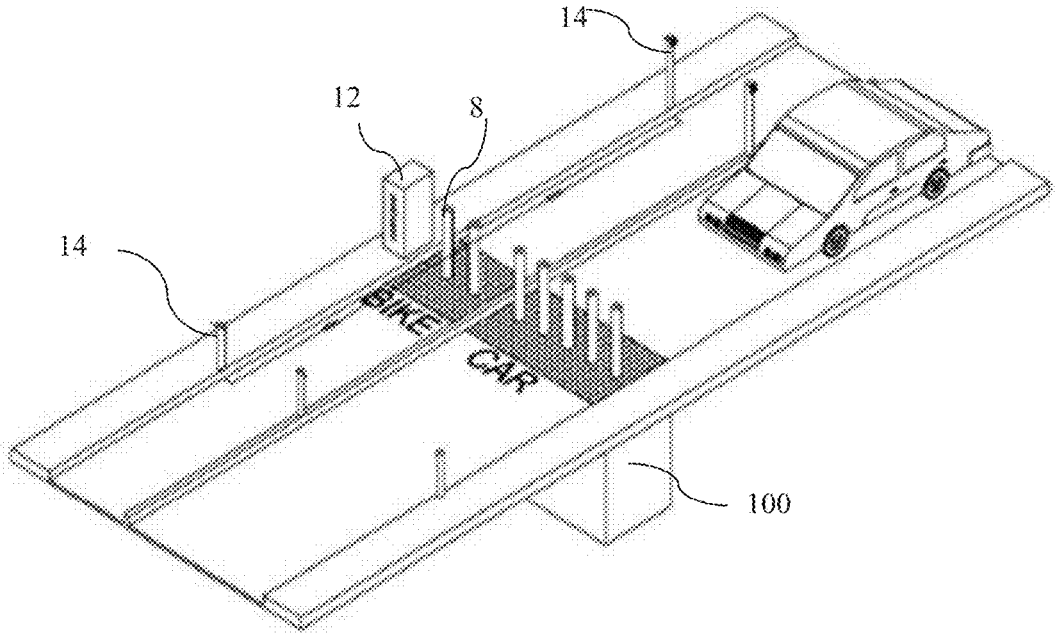
FIG. 8 is schematic diagram of the security system in operation.

Referring to FIG. 8, the working process of the automatic security system (100) when implemented at a check point to avoid the unauthorized entry of the vehicles is explained. The automatic bollard security system (100) may be installed for 2 and 4 or more wheel vehicles. automatic security system (100) may comprise at least one sensor (14) to detect presence of the vehicle and a card reader (not shown) to read the vehicle identification. The card reader may be placed approximately 5 meters (or it can be placed as per convenience) away from the bollards (8) and the exit sensor is placed approximately 4 meters (or it can be placed as per convenience) away from the bollards (8). When the vehicle comes close to the at least one sensor (14) installed at the check point, the card reader/biometric identification (not shown) identifies the vehicle/person and gives signal to the automatic security system (100) via the control panel (12). The control panel may be placed near the automatic security system (100). After receiving the signal indicating the vehicle presence and identifying the vehicle, the bollards (8) go down giving way for the vehicle to pass on the top plate (11). The bollards move down within a period of 1 to 3 seconds or as may be configured by the user for vehicle passage. When the bollards (8) reach down, there is a set of sensors (not shown) and switches (not shown) to give signal for stopping the bollards (8). After the vehicle passes through the exit sensor, the bollards (8) will come up and will be stopped when it reaches the sensors and switches provided at the top and that completes one cycle. There are many safety precautions like at 2000 mm before the bollards there is a warning system, there is a curtain sensor just before the bollards to stop in case of mis-actuation of exit sensor. Also, there provided many measures for the smooth operation of the system. Also, there can be many add on security measures like warning system, in case of vehicle or person pass through the card reader without reading/un authorised biometric or any type of trespassing or even as per the specific requirement, many sensor measures can be added to avoid the security breach.

The bollards system can be used for both ways. All the controls like card reader and other gadgets can be used from other side also.

Figure 3A:
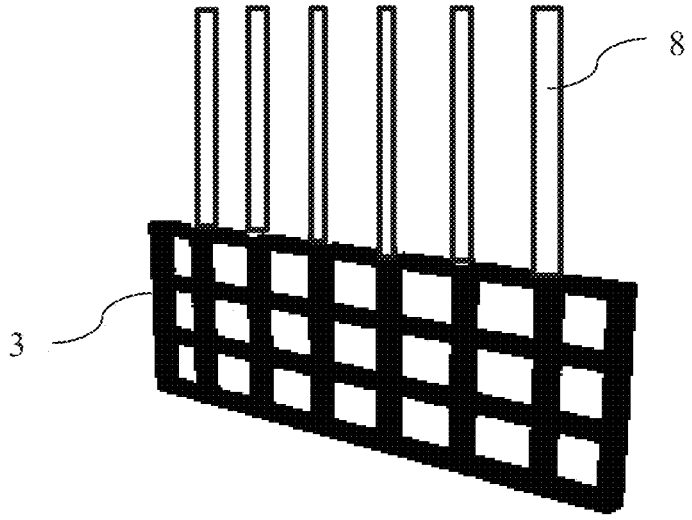
FIGS. 3A and 3B illustrate the security system comprising a main frame and a plurality of bollards.
Figure 3B:
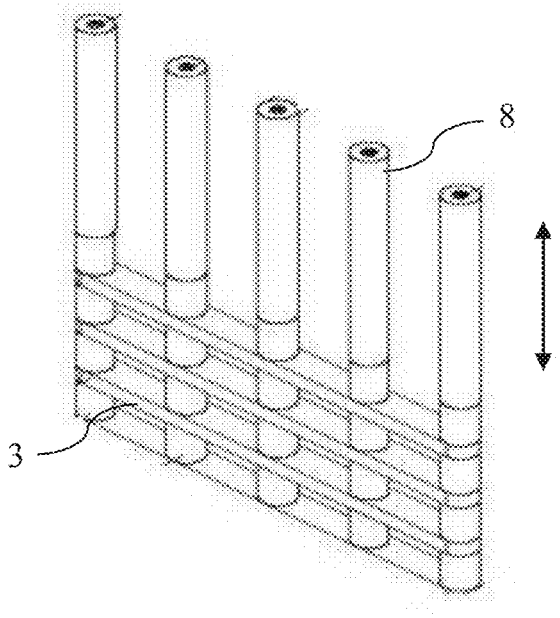

While in idle, the Bollards are in raised position as shown FIGS. 3A and 3B. Incoming vehicle is coming near the Card Reader (as shown in FIG. 8) or punch the card or biometric system or as per the signal generation of the recognition and identification mechanism, after identifying the vehicle/person, the Bollards will go down to facilitate the movement of the vehicle in. When the vehicle fully passes the Exit Sensor (as shown in FIG. 8), the bollards will rise to the normal position as in FIGS. 3A and 3B. The Bollards rising and going down is very quick as the time taken for rising and going down can be within 1 to 3 seconds and if require it can be operated very slow or fast as well.

The complete system/equipment are inserted inside a trench made of RCC or equivalent casing. For the collection of rain water there provided with a collection pit and automatic water pumping facility. Main Electrical Control Panel with PLC should be fitted inside the switch room. Manual operation pendant is provided with the equipment.

All the equipment can be operated together or independently from the Control panel (12) in case of emergency. Otherwise it will be operating automatically as per the PLC program.

In case of power failure Manual Override is provided. In the case of an eventuality, instantly power supply will be sabotaged. In the present invention, this system can be operated UP and DOWN any number of times manually through Manual Override without the requirement of power.

The invention claimed is:

1. A security system for selectively shutting and opening the vehicle entrance or exit or passage ways comprising:

base structure housing a support structure-and a main frame, wherein the main frame comprises a interconnected by steel channels, and wherein the main frame comprises a drive system for moving the bollard up and down;

a guide system for guiding movement of the bollards, wherein the guide system comprises a male and female part;

a counterweight coupled to the plurality of bollards to balance the bollards when moving up and down, with the help of the guide system; and at least one sensor for identification of a vehicle or a person to initiate movement of the bollards in up or down direction.

2. The security system of claim 1, further comprising a top plate to withstand weight of the vehicle.

3. The security system of claim 1, wherein the base structure is constructed to support the support structure, the main frame, the plurality of bollards, and the counterweight.

4. The security system of claim 1, characterized in that the support structure is assembled to the base structure in such a way that it can take the complete upward and downward movement of the bollard along with complete load of the vehicle passing on it.

5. The security system of claim 1, wherein the main frame takes effective weight of the guide, and the counterweight.

6. The security system of claim 1, wherein the male part of the guide system is made of tool steel with phosphorous and the female part is made of steel with phosphorous bronze and is fitted to the male part to reduce the wear and tear.

7. The security system of claim 1, characterized in that the counterweight bears the equivalent load of the moving the bollard and that will minimize the load on the drive.

8. The security system of claim 1, wherein at least one sensor identifies and recognizes the vehicle or person by reading a card reader or a biometric system or any type of signal generation mechanism from a database storing information.

9. The security system of claim 1, wherein the security system can be operated manually.

10. The security system of claim 1, wherein the number of bollards comprises at least one bollard depending on size of the passage way or as per load of the vehicle.

11. The security system of claim 10, wherein height of the bollard is from 1500 mm to 2700 mm.

12. The security system of claim 11 wherein each of the bollards is a seamless tube having a height of 270 mm, a diameter of 150 mm and a thickness of 13 mm.

13. The security system of claim 1, wherein the drive system for moving the bollards up and down is characterized in that having a gear box with a motor for movement along with a drive shaft and at least one pulley—which upon receiving instruction/information moves the bollards up or down.

14. The security system of claim 13 wherein the drive system comprises a pair of pulleys disposed on the drive shaft in spaced relation to each other.

15. The security system of claim 1 wherein the bollards have bottom ends and are interconnected at the bottom ends.

16. The security system of claim 12 wherein each of the bollards is a seamless tube.

* * * * *